US005139356A

United States Patent [19]

Shimada

[11] Patent Number: 5,139,356

[45] Date of Patent: Aug. 18, 1992

[54] SIDE ACTUATED WRITING IMPLEMENT

[75] Inventor: Masashi Shimada, Tokyo, Japan

[73] Assignee: Iwasaki Kinzoku Kogyo Inc., Japan

[21] Appl. No.: 775,218

[22] Filed: Oct. 11, 1991

[30] Foreign Application Priority Data

Oct. 18, 1990 [JP] Japan ..... 2-280047

[51] Int. Cl.[5] ..... B43K 21/16; B43K 24/00

[52] U.S. Cl. ..... 401/65; 401/94; 401/99

[58] Field of Search ..... 401/65, 99, 94

[56] References Cited

U.S. PATENT DOCUMENTS 3,836,264 9/1974 Saito et al. ..... 401/65

*Primary Examiner*—Steven A. Bratlie

*Attorney, Agent, or Firm*—Lucas & Just

[57] ABSTRACT

A side actuated writing implement wherein projections are provided to prevent the wave-shaped actuating member from straightening out.

1 Claim, 4 Drawing Sheets

SIDE ACTUATED WRITING IMPLEMENT

BACKGROUND OF THE INVENTION

This invention relates to writing implements and, more specifically, to mechanical pens and pencils with retractable points.

Writing implements with retractable points are well-known and are generally configured with the writing member located at one end of the casing and a push-button or knocking member located at the other end of the casing. The push button or knocking member actuates the pen tip or writing core to extend for writing or retract for storage. In a writing implement such as a mechanical pencil, the lead is continuously used and the writer must periodically switch grips on the pencil from writing to pushing the knocking member or push-button to supply more lead to the pencil point. This periodic switching of grips is a drawback which was overcome by positioning the knocking member in the side of the casing as disclosed in Japanese Patent Application 89-339069.

In the Japanese '069 application, the knocking member is either pressed in the lengthwise direction, i.e. the direction parallel to the axis of the casing, or in a direction substantially perpendicular to the axis of the casing and acts on an actuating member to cause the pen tip or writing core to extend. If the actuating member is a plurality of rod-shaped members connected together so that they can freely move and form a wave shape, then when they are pressed by the knocking member, all parts of the actuating member straighten out and do not maintain their wave shape. If this happens, the actuating member remains straight in the lengthwise direction of the casing and the knocking member as well as the writing implement no longer functions properly. The present invention is aimed at overcoming this drawback and to provide smooth knocking or push-button action where the push-button or knocking member is positioned in the side of the writing implement.

SUMMARY OF THE INVENTION

This invention is so constructed that when a knock member is pressed, the bent parts of an actuating member are gripped between projections on a support member and a rod of a knock member, and between projections on the knock member and the support member. The wave form of the actuating member is thereby maintained and straightening of all or part of the actuating member is prevented. The activating member is free to contract in the lengthwise direction, and smooth operation of the writing member is guaranteed.

The side knock writing implement of this invention comprises: a knock member free to move from outside the lateral surface of the casing in a substantially perpendicular direction to the lengthwise direction of the casing; a knocked member which makes a writing member protrude due to movement in the lengthwise direction; a wave-shape actuating member comprising a plurality of rod-shaped members connected together which are free to move individually and extend or contract; and a support member inside the casing that supports the actuating member between the knock member and the knocked member. When the knock member is pressed, the actuating member extends in the lengthwise direction guided by the support member, and due to this extension, the knocked member moves in the lengthwise direction so as to expose the writing member.

There are also projections on either the support, the knock member or the rod-shaped members to maintain the wave shape of the actuating member when the latter is pressed by the knock member and extends in the lengthwise direction of the casing.

When the actuating member is pressed by the knock member and extends along the length of the casing, the parts where rod-shaped members are connected together (bent parts) come into contact with projections on the support or the knock member; alternatively, projections on the rod-shaped members themselves come into contact with the support member or knock member. The actuating member is thereby prevented from straightening out, and the rod-shaped members are able to move in the lengthwise and perpendicular directions. After pressing out, the actuating member is retracted by the spring force of an elastic body and returns to its normal condition (condition before it was pressed by the knock member).

BRIEF DESCRIPTION OF THE DRAWINGS

As shown in FIG. 1, casing 1 has opening 1*a* in one side. Writing member 2 is fitted at one end of casing 1. Writing member 2 exposes a writing core or pen tip when it is pressed. The implement shown in FIG. 1 is of a type that the writing core can be advanced repeatedly, and piece 2*a* can be freely retracted.

Figure 1:
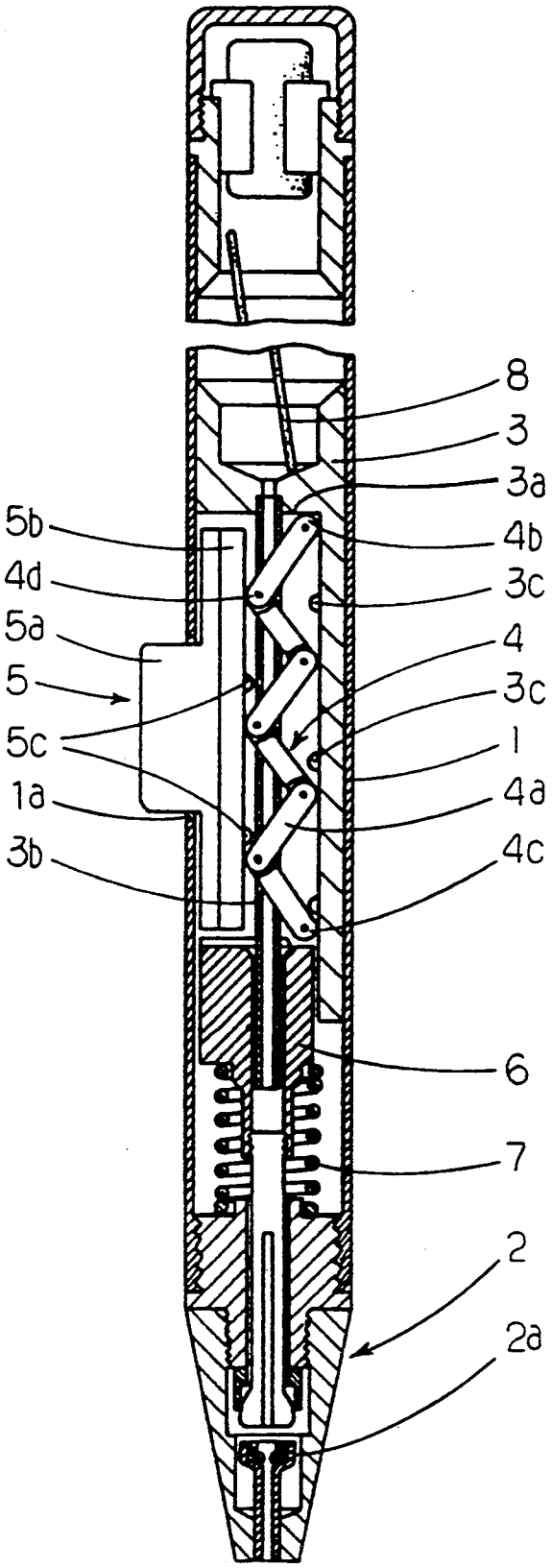
FIG. 1 is taken along a longitudinal axis of a writing implement in accordance with the present invention.

Support member 3 is positioned axially in casing 1. Support member 3 has stop 3*a* and a plurality of projections 3*c*. Support member 3 has a core insertion tube 3*b* which is threaded substantially through the center in the lengthwise direction of casing 1.

Wave-shaped actuating member 4 has bent parts 4*d*. Actuating member 4 in FIGS. 1, 2 and 3 comprises a plurality of rod-shaped members 4*a* connected together which are free to move individually. End 4*b* of actuating member 4 touches stop 3*a*. End 4*c* of actuating member 4 is freely supported on support member 3.

Knock member 5 is fitted to casing 1 such that a knob 5*a* protrudes from opening 1*a*. A plurality of projections 5*c* on rod 5*b* touch the bent parts 4*d* of actuating member 4.

Knocked member 6 acts on writing member 2 when pressed by end 4*c*.

Coil spring 7 is installed between knocked member 6 and writing member 2.

Writing core 8 is shown in FIG. 1. Writing core 8 is typically lead.

Starting from the condition shown in FIG. 1, when knob 5*a* of knock member 5 is pressed (knocked) in a perpendicular direction to the lengthwise direction of casing 1, the bent parts 4*d* of actuating member 4 extend along the length of the casing due to rod 5*b*. However, the movement of end 4*b* is restrained by stop 3*a*, end 4*c* moves downward and pressed knocked member 6 against the force of coil spring 7. Writing member 2 which moves together with knocked member 6 then causes piece 2a to protrude, and the tip of core 8 introduced into writing member 2 via threading tube 3b protrudes from piece 2a.

Figure 2:
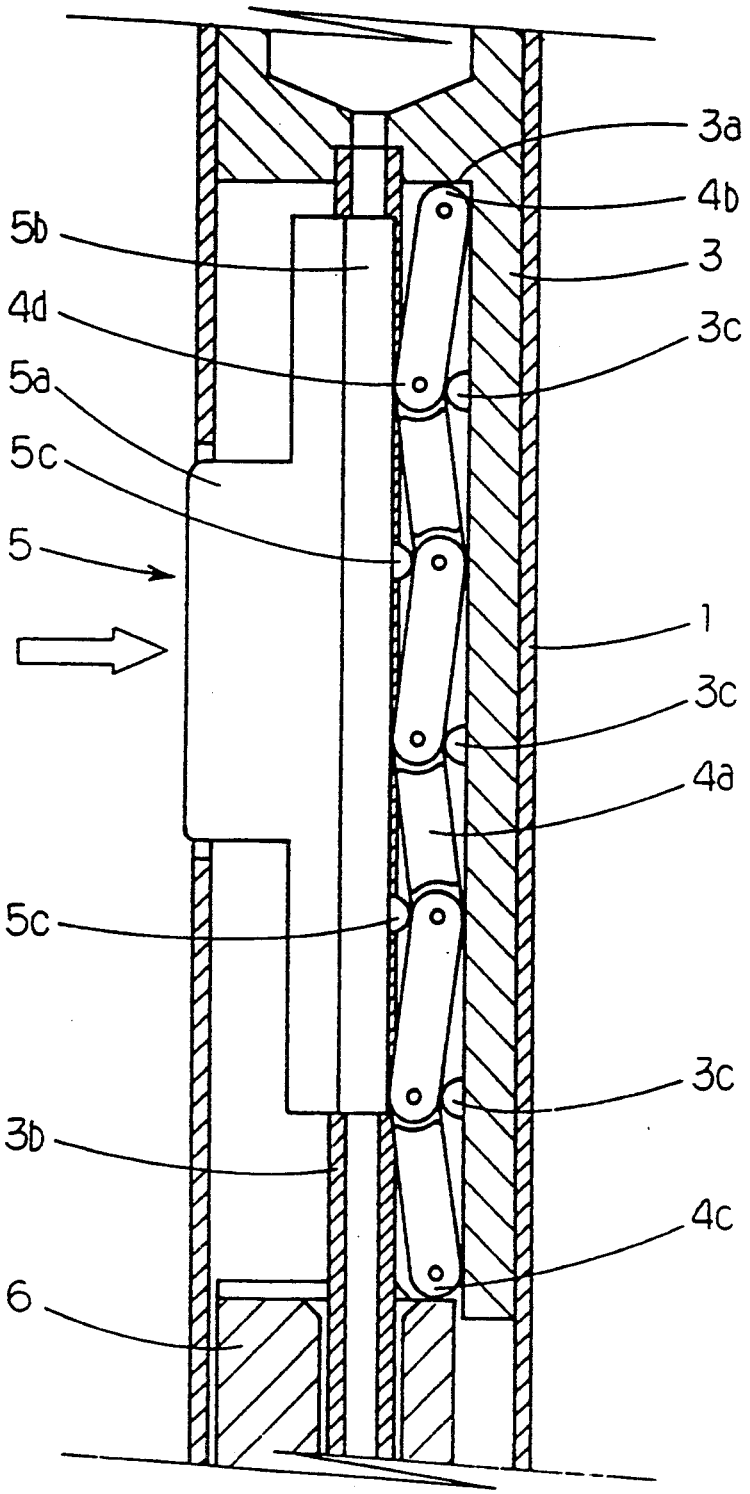
FIG. 2 shows the knocking member depressing the actuating member in accordance with the present invention.
Figure 3:
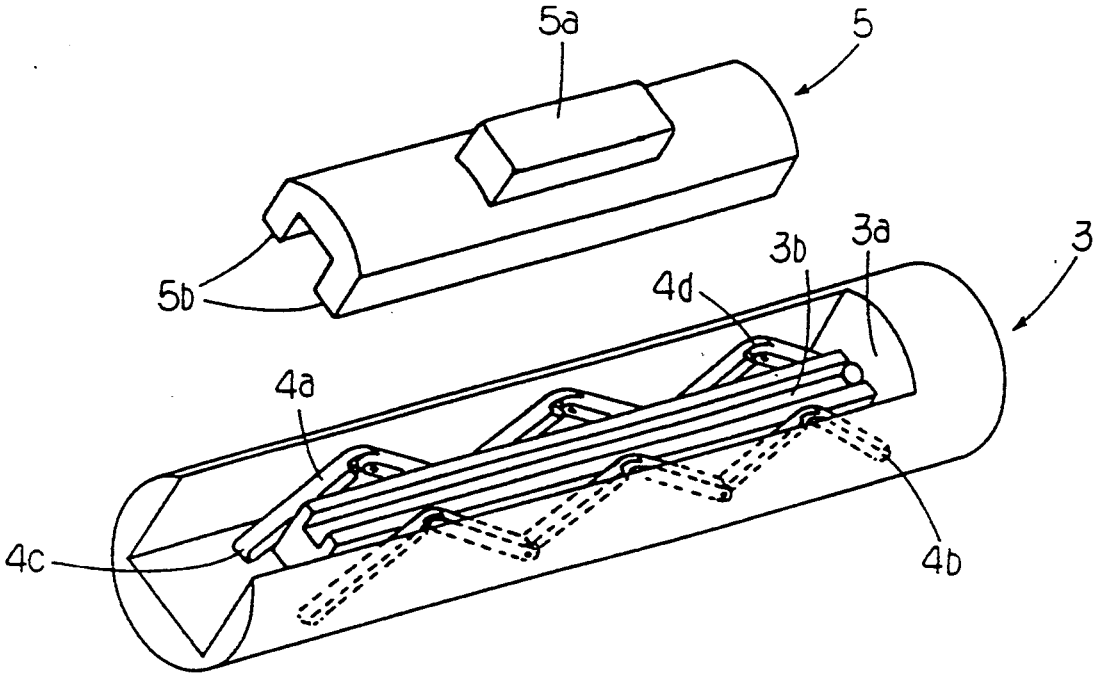
FIG. 3 illustrates a perspective view of a portion of the writing implement of the present invention.

FIG. 2 shows the situation when knock member 5 is pressed. The bent parts 4d of actuating member 4 are gripped alternately between support member 3 and projections 5c or between rod 5b and projections 3c, and knock member 5 cannot be pressed any further. The wave shape of actuating member 4 is therefore maintained, bent parts 4d are able to move in a perpendicular direction to the lengthwise direction of casing 1, end 4c can move together with the upward movement of knock member 6 under the force of coil spring 7, and the whole assembly can be retracted.

Figure 2A:
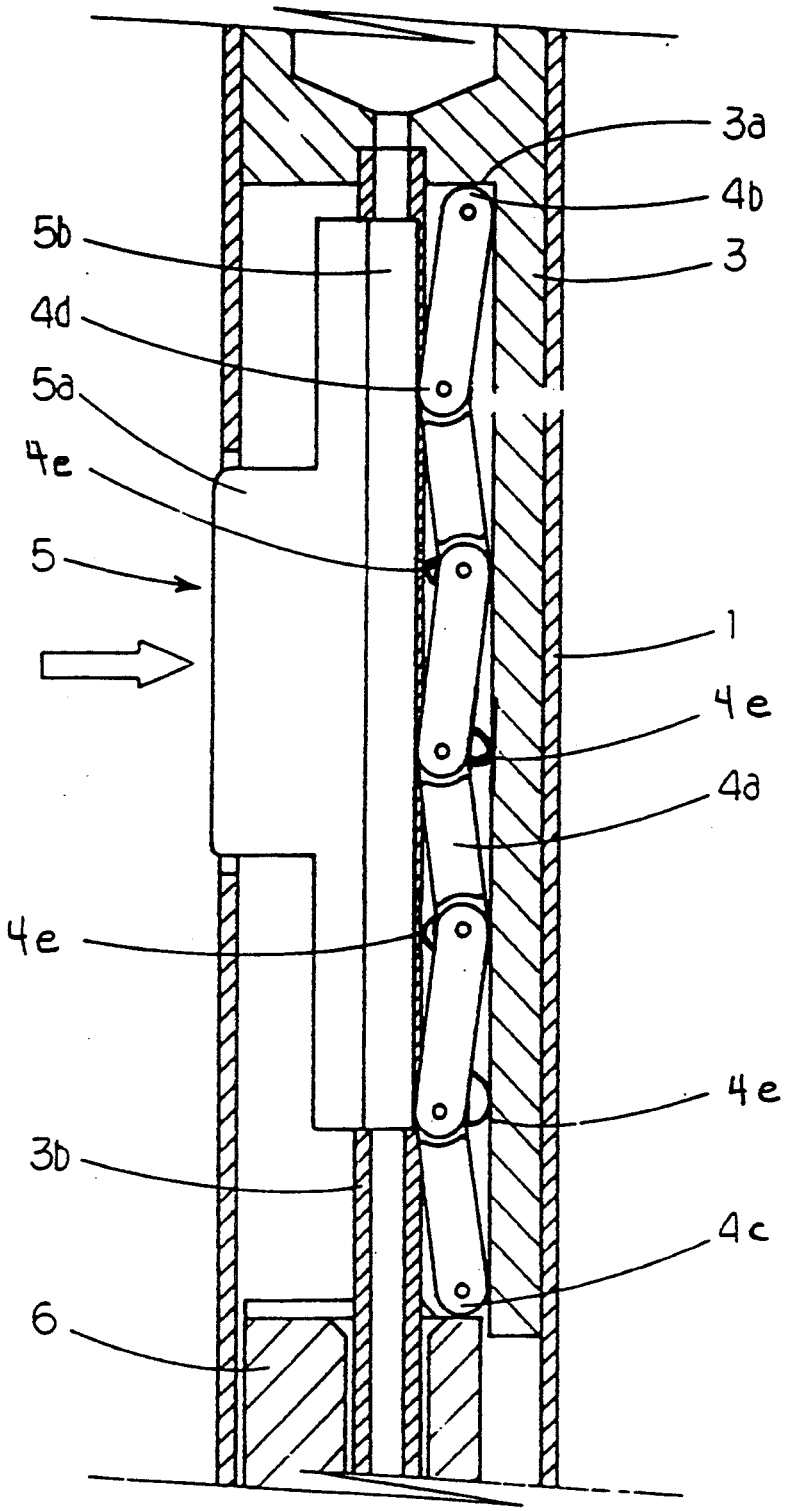
FIG. 2A illustrates the embodiment of the present invention shown in FIG. 2 wherein the projections are on the rod-shaped members instead of the support member and the knock member.

In the Figures, projections 3c and 5c are shown on both support member 3 and knock member 5. It is possible to maintain the wave shape of actuating member 4 and prevent it from straightening out even if projections are present only on support member 3 or knock member 5, however, to ensure that the wave shape is maintained, it is preferable that there are projections on both. Additionally, it is possible to affix projections which correspond to either projections 3c, 5c or both onto wave-shaped actuating member 4 itself rather than on support member 3 and knocking member 5. FIG. 2A illustrates the embodiment in FIG. 2 of the present invention where projections 4e are positioned on the rods themselves rather than on either the actuating member or the support member.

Further, instead of projections on support 3 and knock member 5, projections can be formed in the region of bent parts 4d of rod-shaped members 4a oriented in the direction of movement when these parts are pressed by knock member 5 in order to prevent the wave form of actuating member 4 from straightening out.

Further, the writing member 2 shown in FIG. 1 has a writing core 8 with a repeating action and piece 2a is free to retract. This piece 2a may however also be fixed, and further, the construction may be such as to permit the pen tips of various writing implements such as water-based or oil-based pens to be freely retracted.

Figure 4A:
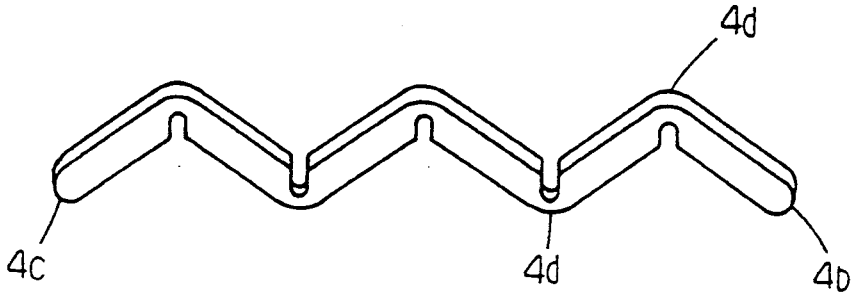
FIGS. 4A and 4B illustrate different actuating members in accordance with the present invention.
Figure 4B:
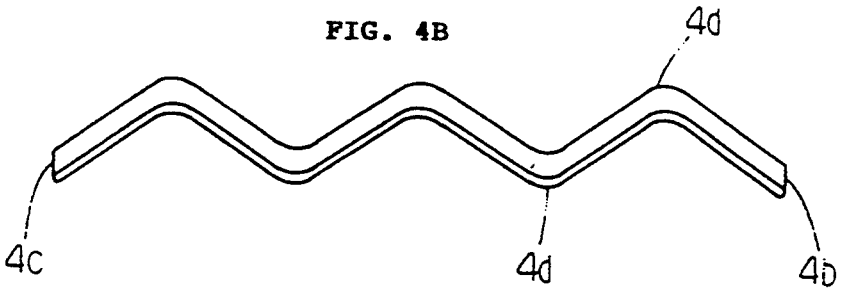

FIGS. 4A and 4B illustrate additional embodiments of wave-shaped actuating member 4 of the present invention.

It will be understood that it is intended to cover all changes and modifications of the preferred embodiment of the invention herein chosen for the purpose of illustration which do not constitute a departure from the spirit and scope of the invention.

What is claimed is:

1. In a side actuated writing implement comprising: a knock member free to move in a direction approximately perpendicular to the lengthwise direction of a casing; a knocked member which when knocked causes a writing member to protrude due to movement in said lengthwise direction; a wave-shaped actuating member having a plurality of rod-shaped members connected together such that they are free to move individually and elongated when pressed upon by said knock member; and a support member which supports said actuating member, the improvement comprising at least one projection affixed to either said support member, said knock member or said rod-shaped members to maintain the wave shape of said actuating member when it elongates in said lengthwise direction.

* * * * *